US005331775A

United States Patent [19]

Carmichael et al.

[11] Patent Number: 5,331,775

[45] Date of Patent: Jul. 26, 1994

[54] HONING PROCESS WITH ROUGH HONING TOOL AND FINISH HONING TOOL ON SAME ROTATING HEAD

[75] Inventors: Guy H. Carmichael, Lakewood; James B. Tyler, Westlake, both of Ohio

[73] Assignee: Jason, Inc., Cleveland, Ohio

[21] Appl. No.: 941,544

[22] Filed: Sep. 8, 1992

[51] Int. Cl.[5] ..... B24B 1/00

[52] U.S. Cl. ..... 51/290; 51/281 P; 51/73 R; 51/326

[58] Field of Search ..... 51/290, 326, 327, 328, 51/281 P, 72 R, 73 R, 312, 313, 32, 245

[56] References Cited

U.S. PATENT DOCUMENTS 5,042,202 8/1991 Klein et al. ..... 51/281 P 5,095,662 3/1992 Grimm et al. ..... 51/281 P

*Primary Examiner*—Bruce M. Kisliuk

*Assistant Examiner*—E. Morgan

*Attorney, Agent, or Firm*—Boisselle & Sklar Renner, Otto

[57] ABSTRACT

A two honing process eliminates the need for subsequent brush honing at another location. The honing process which is accomplished with a single head uses rough honing stones or tools for the initial phase, and finishing tools of tightly compacted abrasive containing plastic monofilaments for the second phase. The phases may be contiguous, slightly spaced, or preferably overlap for up to about one-half of the rough honing phase. When the finishing honing tools are operating alone, the angle of movement of the tools is somewhat askew of the oil retaining ridges and grooves formed by the rough honing operation. With the process, the oil bearing surfaces have improvements in plateau finish and surface topography, avoid abrasive contamination caused by hard finishing tools, and obtain such improvements in a more economic manner.

24 Claims, 3 Drawing Sheets

HONING PROCESS WITH ROUGH HONING TOOL AND FINISH HONING TOOL ON SAME ROTATING HEAD

DISCLOSURE

This invention relates generally as indicated to a honing process associated with sliding sealed surfaces; such as, internal combustion engine cylinders and liners, hydraulic and pneumatic cylinders and other internal machined, bored, drilled and reamed surfaces. In particular it relates to a two-step honing process which eliminates the need for conventional finish honing stones, and also any subsequent brush honing operation. A somewhat yielding, tightly packed abrasive monofilament tool is used in lieu of the conventional finish honing stones or steel tools, and the two steps are performed at a single station.

BACKGROUND OF THE INVENTION

Oil bearing surfaces such as typically found in cylinders or cylinder liners of internal combustion engines, or piston-cylinder assemblies, commonly called linear actuators, have special material surfaces. These surfaces have a special topography and are usually formed first by a rough hone and then a finish hone. both rough and finish hones are "stones" mounted in a honing machine head which rotates and axially translates the stones within the cylindrical bore of the surface. Both rough and finish hones are usually mounted in the same honing machine head and the operations take place sequentially at the same location. Also used in the rough and finish operations are steel holders with abrasive minerals plated thereon. In either case the tool is rigid and presents in the operation an unyielding abrasive-work interface.

The resultant surface has folded over peaks, folded over metal and debris in the bottom of the cross hatching oil grooves. This is true even though the surface is constantly flushed with lubricant or coolant during the honing operations.

In operation, the rough honing tools which contain a coarse adbrasive grit are pressed against the cylinder walls to perform the work required. After a predetermined time cycle the rough honing tools are retracted into the honing head and the finish honing tools, containing a very fine abrasive grit, are pressed against the cylinder walls during the final finishing operation.

The rough hone forms in the surface a pattern of ridges and grooves, almost like a cross hatch pattern. These grooves or striations are the oil retention pattern against which the piston or piston rings ride. Unfortunately when the rough hone operation is completed the surface greatly enlarged shows deep peaks and valleys or other sharp projections which can break off, and which would contribute to piston or ring wear, and all of the detrimental performance, life and environmental problems associated therewith. For example, ring or piston wear is the cause of "blow by" which can create all kinds of emission problems in an internal combustion engine. The purpose of the finish hone is to smooth over the peaks and valleys.

It has been discovered that rigid finish hones, while somewhat improving the topography of the surface, can in many instances actually contaminate the surface by driving or embedding dislodged hard abrasive particles into the surface. This has been determined by photomicrographs and by tests of engines and engine oil after break in. The particle is usually driven into the slope or crown of a ridge which is the seal bearing surface. Thus, instead of the surface being improved, it has been made worse. A projecting hard abrasive particle will score a piston ring or seal causing premature failure, blow by, and poor engine efficiency, for example, and most of the other problems honing is supposed to address.

During recent years, to correct these problems and to improve upon the final finishing results, a second honing head was added to a few high production automotive engine block lines directly after the rough and finishing honing operation. The honing tools used were, superabrasives plated on very fine wire filaments, lightly filled, and fine abrasive nylon brushes. Results of this added operation have been questionable based upon quality improvements and economic justification.

A second head brush hone using very fine spaced bristles may be seen in European Patent Publication 0 247 572. A post hone brushing machine is also seen in U.S. Pat. No. 5,042,202. In U.S. Pat. No. 4,980,996 there is illustrated a machine using tufted spaced bristles in combination with a high pressure spray or jet to remove metal nap after honing.

Also recently used in post honing second station operations are honing tools of the type shown in the copending application of Scheider and Warner, Ser. No. 07/508,060, entitled "Abrasive Filament Honing Tool And Method of Making And Using The Same", filed Dec. 14, 1989 now U.S. Pat. No. 5,216,847. The tool of this copending application comprises tightly packed nylon-abrasive filaments which form a dense and compact slightly yieldable face. Such tool has been performing adequately in post honing, second station operations to improve honed surfaces.

It would be advantageous to combine the post honing second station operation using the abrasive filament honing tool, with the rough hone operation, thus eliminating the conventional finish hone operation, as well as the second station operation. This would eliminate the requirement for expensive finish hones, and would also eliminate any contamination caused by such hones. It would also significantly shorten and simplify the entire honing operation. The advantage of such a combination and the elimination of the finish hone step can only be realized if proper or improved surface topography is obtained. Applicants have discovered that it is.

SUMMARY OF THE INVENTION

The present invention eliminates the need for the conventionally used finishing step in the honing process and eliminates the need for hard metal or stone finishing hones, and of course any contamination caused thereby. Instead of such finish hone stones, applicants use as the only finishing step tightly packed slightly flexible abrasive monofilament honing tools, such tools having filament diameters and shapes significantly larger than 0.005 inch (0.127 mm), and abrasive grain sizes between 80 and 1000 mesh, and higher.

It has been discovered that these tightly packed slightly soft or yielding tools actually absorb debris from the surface, do not contaminate the surface, and also provide an improved surface topography.

It has also been discovered that such tools can effectively be used with the rough honing tools in a single head, and can commence operation at a controlled pressure either immediately after the rough honing operation, or with some overlap.

Most peaks and microburrs produced by cutting, plowing and furrowing are formed in the second half of the rough honing operation, and the rough honing stone usually simply folds them over making them more difficult to remove. Concurrent operation of the rough honing stones and the softer tightly packed monofilament tools during the second half of the rough honing step assists in removing such peaks and microburrs before the rough hone stones fold them over. The overlap also enables the loose abrasive absorption characteristic of the finishing tools to operate on the surface before the rough hones are fully retracted, resulting in less potential contamination of the surface.

It has also been found that the most effective use of such tightly packed monofilament tools as the finishing tools in the two step honing process can be achieved if the tools are moved at an acute angle with respect to the ridges and grooves formed by the rough hone operation, and at a controlled pressure.

Rotational speeds for the soft abrasive tools are compatible with existing honing machines and range between 100 rpm to 1200 rpm. The preferred operating range for most efficient results in 180 rpm to 280 rpm.

Applicants' invention then comprises a process which results in a more economical honing operation, and also produces cylinders or bores which in an internal combustion engine require little or no break in period, minimizes the amount of oil burned, reduces emissions, and has less potential for engine scoring and metallic contamination.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE PREFERRED EMBODIMENTS

Figure 1:
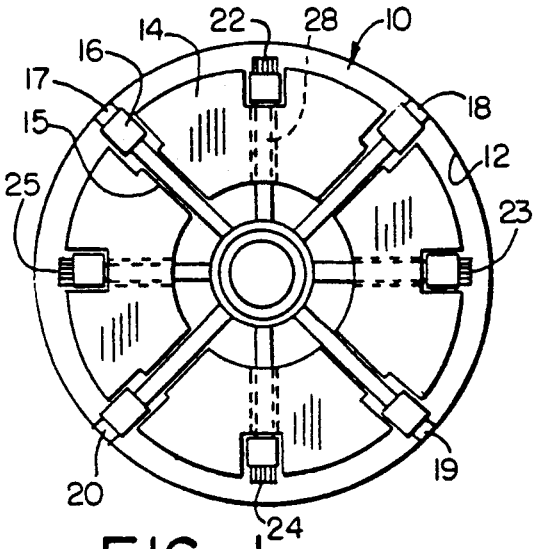
FIG. 1 is a schematic transaxial view through a honing head in accordance with the present invention illustrating the rough honing stones extended inside a cylinder and the abrasive filament finishing tools retracted.
Figure 2:
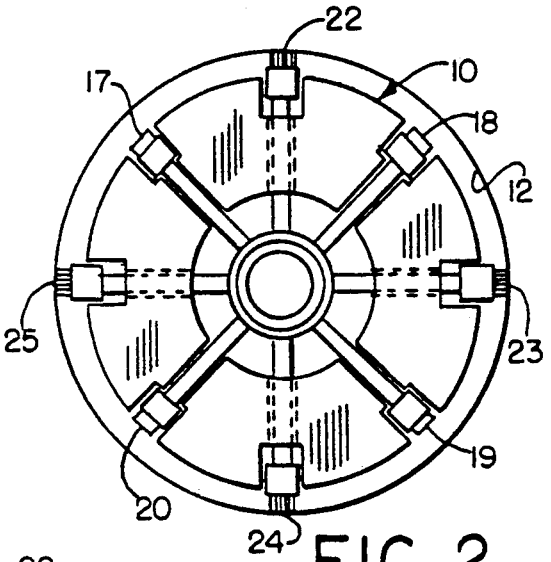
FIG. 2 is a similar view with only the finishing tools extended.
Figure 3:
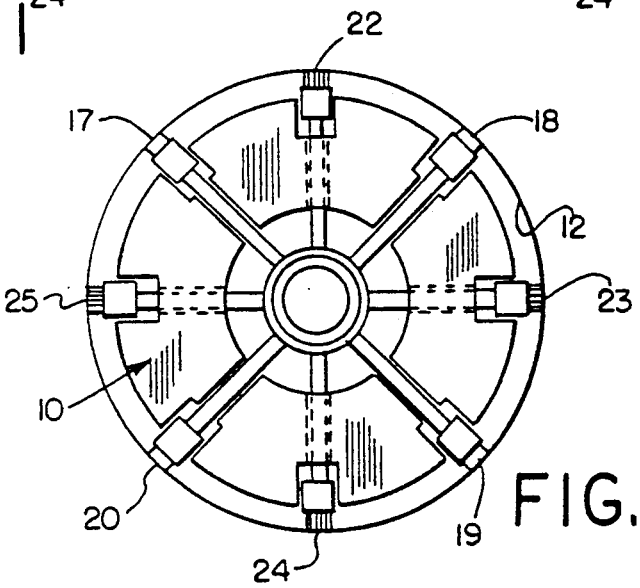
FIG. 3 is a similar view with both the rough and finishing tools extended.

Referring initially to FIGS. 1, 2 and 3 there is illustrated somewhat schematically in transaxial section the two quill honing head indicated generally at 10 honing the inside of cylindrical surface 12. The particular honing head illustrated includes an annular body 14 having radial passages 15 for supporting for radial movement holders 16 for rough honing stones 17. In the illustrated embodiment there are four such rough honing stones as seen at 17, 18, 19 and 20, quadrant spaced around the axis of the head.

Interposed equidistantly between each rough honing stone are the softer compacted monofilament finishing hone tools indicated at 22, 23, 24 and 25, also quadrant spaced between the rough honing stones. The softer finishing tools are mounted on tool holders seen at 28 and are mounted in the honing head 10 for radial expansion and contraction independently of the rough honing stones.

In comparing FIGS. 1, 2 and 3 it will be noted that in FIG. 1 the rough honing stones are shown extended working on the interior of the surface 12. In FIG. 2 the highly compacted softer monofilament tools 22–25 are shown extended while the rough hones are retracted or submerged. In FIG. 3, both the rough honing stones and the softer tightly packed monofilament finishing hone tools are extended.

Figure 4:
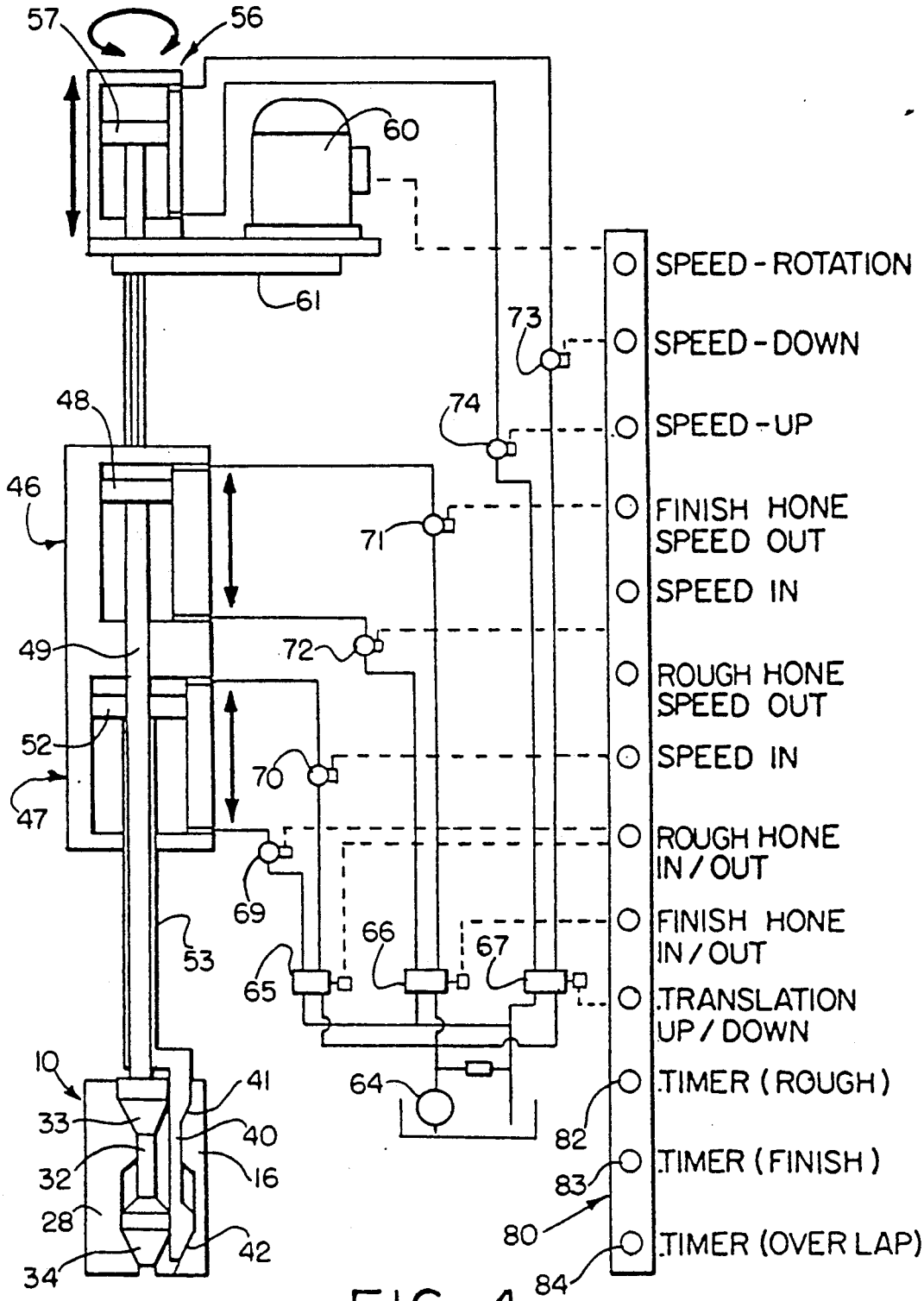
FIG. 4 is a schematic illustration of a honing machine for practicing the process of the present invention.
Figure 8:
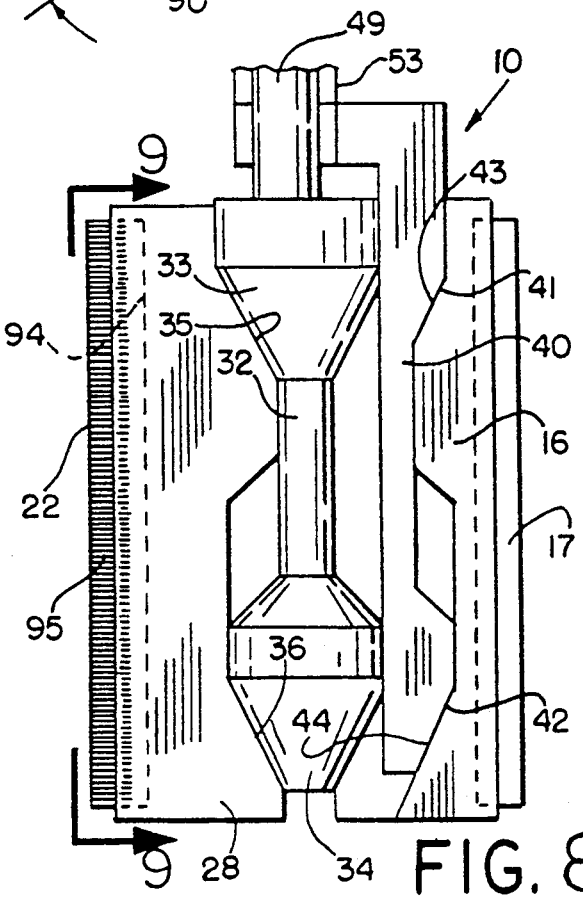
FIG. 8 is an enlarged schematic illustration of the two quill head for selective operation of the rough and finish hone tools.

Referring now to FIG. 4 and also to FIG. 8, it will be seen that the honing head 10 includes an inner linear cam 32 having two conical cam surfaces 33 and 34 which mate with axially inclined surfaces 35 and 36 on the interior of the finishing hone tool holder 28.

Similarly, an axially slotted linear cam 40 is provided with conical surfaces 41 and 42 which mate with axially inclined surfaces 43 and 44, respectively, on the interior of tool holder 16 for honing stone 17. Garter springs, not shown, hold the tool holders against the cam surfaces.

The two linear cams are moved independently by double acting hydraulic piston-cylinder assemblies shown generally at 46 and 47. The piston 48 of assembly 46 moves rod 49 which is connected to the cam 32. The rod 49 extends through piston 52 and hollow rod 53 of assembly 47. The rod 53 drives the cam 40.

The entire honing head is moved axially for axial translational movement by hydraulic piston-cylinder assembly 56 with the piston 57 moving the entire housing for the cylinders of the piston-cylinder assemblies 46 and 47. The entire honing head, in addition to being movable axially for translational movement, is also driven for rotation by reversible variable speed motor 60 through transmission 61.

The machine, the components of which have just been described, is generally conventional, and is used commercially at present for the operation of rough and finishing hone stones. FIG. 4 illustrates such a machine adapted to practice the process of the present invention.

The hydraulic control system includes a pump 64 supplying hydraulic fluid to directional control valves 65, 66 and 67. Each line to the piston-cylinder assembly 47 is provided with a flow control valve as seen at 69 and 70. The two lines to the piston-cylinder assembly 46 are also provided with flow control valves seen at 71 and 72. Finally, the two lines to the piston-cylinder assembly 56 are also provided with flow control valves indicated at 73 and 74. Such flow control valves control speed and pressure.

The flow control valves as well as the directional valves are controlled from a control panel indicated generally at 80. Some of the functions of the control panel are indicated by the selection legends although it will be appreciated that a sophisticated programmable control system is provided so that such selected parameters of operation may be repeated precisely many times an hour. For example, a modern engine plant will produce as many as two hundred or more engine blocks per hour.

The control panel of course controls the speed and direction of the motor 60 and, through the valves 73 and 74, the axial translational speed in and out obtained by the piston-cylinder assembly 56. The speed and pressure of the finish hones moving radially is controlled by the flow control valves 71 and 72. Likewise, the rough hones speed and pressure moving radially is controlled by the flow control valves 69 and 70. The in and out movement of the rough hones is controlled by the directional valve 65 while the in and out movement of the finish hones is controlled by the directional valve 66. The translation of the entire head up (out) and down (in) is controlled by directional valve 67.

In addition, the control panel 80 may contain at least three timers indicated at 82, 83 and 84. The timer 82 controls the duration of the rough honing cycle while the timer 83 controls the duration of the finish honing cycle, and timer 84 controls the duration of concurrent operation of the rough and finish tools. The timer 84 commences operation with the initial rough honing cycle, times out after a predetermined time period to commence operation of the finish honing cycle, and then times out again to conclude the rough honing cycle. As will be hereinafter described the timers may be operated in a variety of ways to provide consecutive yet sequential rough and finish honing, or with a hiatus therebetween during which constant flushing continues. However, the preferred process utilizes some overlap between the rough and finishing steps, and as will be seen in FIG. 6, the preferred overlap is for approximately the second half of the rough honing operation.

In any event with the machine and the controls illustrated, the rotation and translation of the rough and finishing tools can be closely controlled, as well as their speed of application and pressure, to operate the process to achieve the desired surface topography in an economical time cycle.

Figure 7:
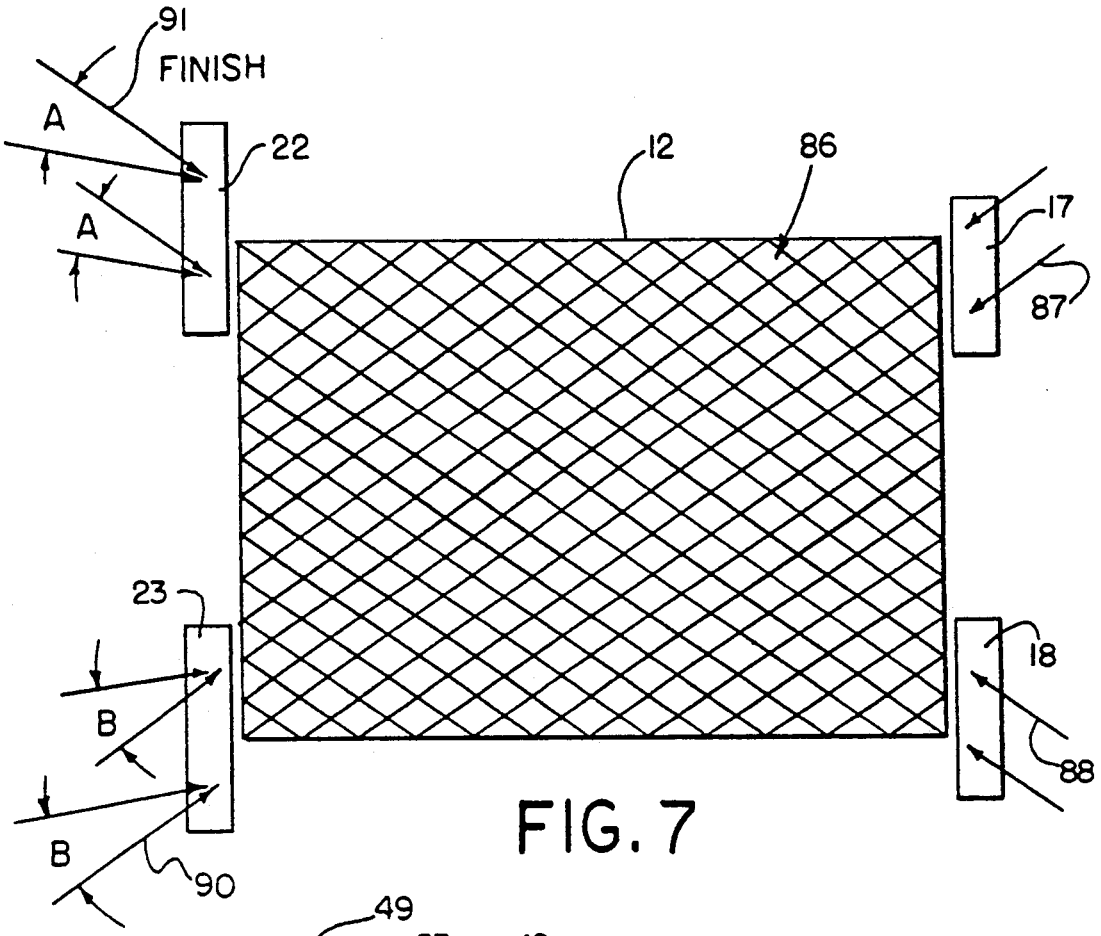
FIG. 7 is an illustration of the cross hatch pattern formed by the rough hones, and the preferred range of acute angular variation of the finish honing tools, when the operation of the rough hones has been completed.

Referring now to FIG. 7 it will be seen that the rough honing stones indicated schematically at 17 and 18 are moved both axially and rotationally to travel with respect to the developed work surface 12 to form the cross hatching pattern schematically indicated at 86. This cross hatching pattern is obtained simply by moving the stones in the direction of the arrows 87 and 88 with respect to the developed surface 12 creating the cross hatch pattern of ridges and grooves. In the schematic of FIG. 7 each line may, for example, represent an inwardly projecting ridge. This cross hatch pattern is produced intentionally and in any piston-cylinder surface helps maintain the proper lubrication or oil film.

When the finish hone tools operate on such surface after the rough hone stones have been retracted or submerged, it is preferred to vary the direction of movement of the finish hone tools so that they are moving preferably at an acute angle with respect to the ridges and grooves. This angle is indicated by the angles A and B seen in FIG. 7 and may vary from zero to approximately 45° and preferably not more than 30° with respect to the groove and ridge pattern, and preferably away from the axis of rotation which would be a vertical axis through the figure. A preferred angular range is from about 10° to about 30°. In this manner, when the finish hone soft tools are operating without the rough hone tools during the latter portion of the cycle, it is preferred that the tools be drawn across the ridges and grooves at an acute angle as illustrated. A 30° angle of movement is shown by the angles A and B seen in FIG. 7 and may be obtained by simply slowing down the axial reciprocation of the head.

Figure 9:
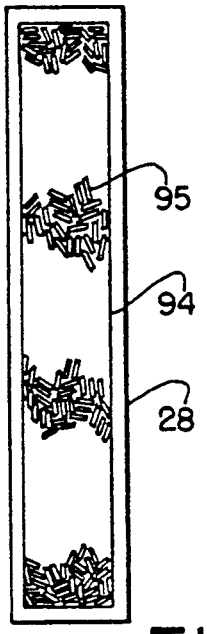
FIG. 9 is a view of the working face of the finish honing tool showing the tightly packed somewhat yielding surface.

Referring now to FIGS. 8 and 9, it will be seen that the holder 28 may take a variety of shapes but includes an elongated recess indicated at 94 into which a bundle of relatively short parallel abrasive containing nylon monofilaments are inserted. The rectangular monofilaments may typically be 0.09 inch wide and about 0.045 inch thick. Somewhat wider rectangular filaments or round filaments may be employed so long as they are packed as close together as possible. The surface presented is a dense yet somewhat flexible tightly packed bundle of the tips of such filaments. The tips on the inner portions of the bundle have little or no flexibility while the tips on the outer edges of the bundle have some flexibility, yet mostly away from the bundle. The tips may lie in the same plane or the face of the tool may be that of the cylindrical surface. The abrasive is homogeneously entrained in the synthetic plastic material and may typically be 30 to 45% by weight of the filament. The abrasive material may vary widely from silicon carbide to a more exotic material such as diamond. The abrasive grain sizes may also vary widely as from about 80 mesh to 1000 mesh and above. Although nylon is the preferred material for the monofilaments, other plastic materials are useful such as aramids, polyesters and polyimides. The particular method of manufacturing and construction of the preferred honing finishing tools for practicing the process of this invention and its method of manufacture is disclosed in the aforenoted copending application Ser. No. 07/508,060 filed Apr. 11, 1990 and entitled "Abrasive Filament Honing Tool And Method Of Making And Using Same", and such application is incorporated herein by reference.

Referring back to FIG. 5 there is illustrated a time diagram which illustrates the rough honing step 98 being performed before the finish honing step and without a hiatus therebetween. As illustrated in the example, the two steps take approximately 20 seconds and the overall cycle, 40 seconds.

Figure 6:
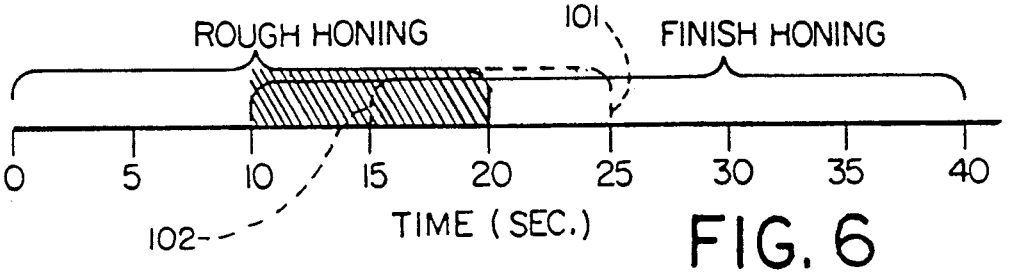
FIG. 6 is a similar time diagram showing an overlap in the rough and finish honing.

However, FIG. 6 illustrates the preferred process of the present invention and that is where the rough honing and finish honing steps overlap. It is preferred that the overlap occur through the second half of the rough honing step. As indicated, the second half of the rough honing operation is usually the portion of that cycle which creates the most prominent peaks and microburrs which are then folded over and more difficult to remove or properly reduce.

In the illustrated cycle, the rough honing takes approximately 20 seconds. However, after 10 seconds, the finish hone tools are extended and the second half of the rough honing operation is completed with both sets of tools extended. At the completion of the rough honing cycle the rough hone tools only are submerged and the honing continues with only the finish hone tools extended. In such embodiment, the finish hone tools are extended for most of the second half of the rough honing operation.

It will be appreciated that the cycle times illustrated are exemplary only and may vary widely depending upon the type, size and material of the cylinder being honed.

As illustrated in FIG. 6, the cycle starts and for the first ten seconds the rough hone stones operate alone. For the next ten seconds both operate together, and for the final twenty seconds, the finish hone tools operate alone. Thus the finish hone tools operate for three-quarters of the whole cycle. It is also possible to extend the overlap by continuing the rough honing operation beyond the half-way point of the cycle as indicated by the dotted line 101. It is also possible to reduce the overlap to approximately the last fourth of the rough honing cycle as indicated by the dotted line 102. Accordingly, the overlap may vary in time length and itself may shift toward either end of the complete cycle.

Figure 5:
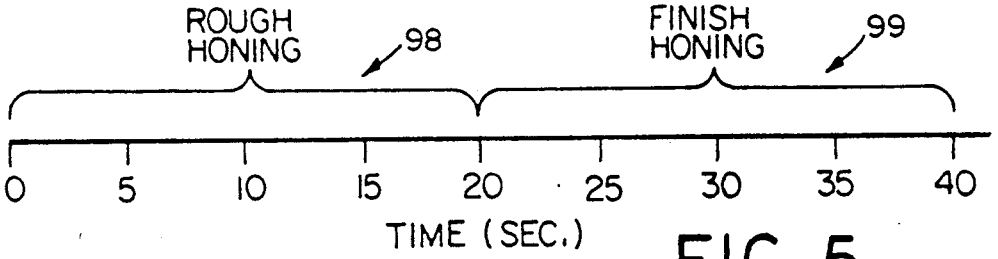
FIG. 5 is an exemplary time diagram illustrating the rough and finishing steps occurring in sequence.

Although in both illustrations in FIGS. 5 and 6, the rough honing and finish honing operation is continuous, it will be appreciated that a hiatus may be built in to the program between the two, or at any place in either operation to permit flushing to continue without the rough or finish tools being in operation. As indicated, it is also preferable to change the angle of the tack somewhat when the finishing tools are operating alone.

With the present invention significant improvement in plateau finishing and the topography of oil bearing surfaces is achieved with economies of operation. The process produces cylinder bores which require little or no break in periods, minimizes the amount of oil burned, and is environmentally beneficial because of less emission. The avoidance of contamination caused by hard or conventional types of finishing honing tools minimizes the potential for engine scoring and metallic or abrasive contamination.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A method of honing a cylindrical surface having an axis comprising the steps of rough honing the cylindrical surface for a predetermined time by moving a rough honing tool over such surface both rotationally and axially with respect to said surface to impart a cross honing pattern thereto, which pattern comprises crossing helical ridges and grooves forming striations on the cylindrical surface, and after commencement of the rough honing step then finish honing such surface by moving a finishing hone tool over such surface both rotationally and axially with respect to said surface, said finish honing step being completed after the completion of the rough honing step, said finishing hone tool having a working face of tightly compacted tips of abrasive containing plastic monofilaments wherein said rough honing is obtained with a rough honing stone tool, and said finish honing is obtained with a finish honing tool, both tools being mounted in the same rotating head

2. A method as set forth in claim 1 wherein said rough and finish honing steps are performed at the same location.

3. A method as set forth in claim 1 wherein said rough and finish honing steps are performed consecutively.

4. A method as set forth in claim 1 wherein said rough and finish honing steps are performed consecutively and partly concurrently.

5. A method as set forth in claim 4 wherein said steps are performed concurrently for about half of the time of the rough honing step.

6. A method as set forth in claim 1 wherein said tips are moved at an angle to said striations.

7. A method as set forth in claim 6 wherein said head is mounted for axial movement within said cylindrical surface, and said angle is obtained by controlling such movement.

8. A method as set forth in claim 7 wherein said direction is from 0° to about 30° with respect to said striations.

9. A method as set forth in claim 7 wherein said direction is obtained by controlling the speed of rotation of said head.

10. A method as set forth in claim 7 wherein said direction is obtained by controlling the axial movement of the head.

11. A method as set forth in claim 7 wherein said direction is obtained by controlling both the speed of rotation and the axial movement.

12. A method as set forth in claim 1 wherein said tips are moved in a selected direction with respect to said striations by slowing the axial movement of said finishing hone tool.

13. A method as set forth in claim 12 wherein said tools are mounted in said head for independent radial extension and retraction.

14. A method as set forth in claim 13 wherein said rough honing tools alternate with said finish honing tools in said head.

15. A method as set forth in claim 12 wherein said direction is from about 10° to about 30°.

16. A method of honing comprising the steps of mounting a rough honing tool set and a finish honing tool set on a single rotatable and axially reciprocable head, each set being mounted for radial extension and retraction independently of the other, the rough honing tool set comprising rigid tools operative to form a cross hatch pattern in the surface being honed, and the finish honing tool set comprising softer tools, the working faces of which are tips of a tightly compacted bundle of plastic monofilaments with abrasive homogeneously embedded therein, extending the rough honing tool set while rotating and reciprocating the head within a cylindrical surface to be honed, to form a cross hatch ridge and groove pattern thereon, and then extending the finish honing tool set to improve the topography of the rough honed surface.

17. A method as set forth in claim 16 including the step of retracting the rough hone tool set after the finish hone tool set has been extended.

18. A method as set forth in claim 17 wherein said rough hone tool set and said finish hone tool set are both extended for a substantial intermediate overlap phase of the overall process.

19. A method as set forth in claim 18 wherein said intermediate overlap phase includes approximately the last half of the operation of the rough honing tool set extended.

20. A method as set forth in claim 19 wherein the rough honing tools and finish honing tools alternate around the head.

21. A method as set forth in claim 16 including the step of changing the movement of the head when the rough honing tool set has been retracted.

22. A method as set forth in claim 21 wherein such change of movement causes the finish honing tools to move askew across the grooves of the cross hatch pattern.

23. A method as set forth in claim 22 wherein the skew of such movement is from 0° to about 30°.

24. A method as set forth in claim 23 wherein the skew of such movement is from about 10° to about 30°.

* * * * *